United States Patent [19]

Bocinski et al.

[11] 4,389,770

[45] Jun. 28, 1983

[54] TRI-LEAD CABLE HOUSING REMOVAL TOOL

[75] Inventors: Terrance E. Bocinski, Binghamton; Alan D. Knight, Newark Valley, both of N.Y.

[73] Assignee: International Business Machines Corporation, Armonk, N.Y.

[21] Appl. No.: 208,228

[22] Filed: Nov. 19, 1980

[51] Int. Cl.[3] ..... H01R 43/00

[52] U.S. Cl. ..... 29/764; 29/758; 294/1 R; 294/100

[58] Field of Search ..... 29/739, 741, 764, 758, 29/747, 278; 294/99 R, 99 S, 101, 100, 26, 1 R, 19 R

[56] References Cited

U.S. PATENT DOCUMENTS 2,853,772 9/1958 Yuter ..... 29/278

3,769,680 11/1973 Anhalt ..... 29/764

4,059,331 11/1977 Sedlacek ..... 339/198 R

*Primary Examiner*—Carl E. Hall

*Attorney, Agent, or Firm*—Gerald R. Gugger

[57] ABSTRACT

A tool for removing from a housing a tri-lead cable having an end terminal removably retained in the housing and having a portion covered by an encapsulating film which extends partially into the housing. The tool comprises a hollow elongated body member having a spring-biased plunger mounted therein. A spring hook blade is attached to the plunger and extends out an open end of the body member. The spring blade is adapted to be inserted in between the housing and the encapsulating film to hook onto an edge of the film. Grasping means are provided on the body member for compressing the spring-biased plunger to retract the spring hook blade and remove the hooked tri-lead cable from the housing.

5 Claims, 4 Drawing Figures

TRI-LEAD CABLE HOUSING REMOVAL TOOL

BACKGROUND OF THE INVENTION

In printed circuit technology, a card-on-board package assembly is employed which comprises a printed circuit board, a board stiffener secured to the board, a card guide assembly fastened to the stiffener, and a plurality of printed circuit cards mounted in the guide assembly to make electrical contact with the board. The other side of the board is the wiring or probe side and protruding from this side of the board are a plurality of signal voltage pins and ground voltage rails.

Tri-lead cables are used to interconnect among the signal pins anywhere on the wiring side of the board for making circuits complete which cannot be imbedded in the printed circuitry. They are also used to make engineering changes and to upgrade a printed circuit board in the field. The tri-lead cable consists of one signal conductor and two ground conductors that are encapsulated in a dialectric material to provide the desired impedance. The connector portion consists of a tuning fork contact connected to the signal conductor and another tuning fork contact connected to the two ground conductors. The tuning fork contacts and the end portions of the conductors to which they are connected are removably retained in a pluggable housing which facilitates the plugging of the tuning fork contacts onto the signal pins and ground rails on the printed circuit board.

Damage to a signal pin or to the tuning fork contacts, or making an engineering change, or upgrading the printed circuit board, may call for the removal of the tri-lead cable from the housing. The tuning fork contacts have barbs on their ends which latch onto ledges inside the housing. To remove the cable, the practice was to grasp the encapsulated conductor wires with a pair of needle nose pliers and pull the cable assembly out of the housing. As a result, uncontrolled pressure is being applied to the ground and signal wires crushing the wires together causing intermittent and/or dead shorts. It became evident that a tool was required whereby the tri-lead cable could be removed from the housing without uncontrolled pressure being applied to the wires.

SUMMARY OF THE INVENTION

The present invention provides a tool which eliminates the cable shorting problem and is faster and safer to remove a tri-lead cable from a housing cleanly, thereby eliminating long and costly system down times which are presently being experienced in system bring-ups in manufacturing plants and in customers offices caused by previously pulling cables with pliers.

The tool comprises a hollow elongated barrel member in which is mounted a spring-biased plunger. Attached to the plunger is a thin spring blade which extends out an open end of the barrel member and on the exposed end of the blade is a projection or hook portion. A spring in the barrel normally maintains the plunger and blade in an outward or extended position. Hand grasping means are provided for retracting the plunger and blade inwardly in the barrel. A tuning fork or slotted portion extends from the end of the barrel for alignment purposes.

To remove a tri-lead cable from a housing, the housing is removed from the circuit board and the spring blade of the tool is inserted in between the housing and the encapsulating film of the cable assembly to hook onto an edge of the film. The tuning fork portion of the barrel slides into a T-bar projection on the housing for alignment. The spring is then manually compressed to extract the cable assembly from the housing with no damage occuring.

Accordingly, a primary object of the present invention is to provide a novel and useful tool for removing a tri-lead cable from a housing.

Another object of the present invention is to provide a new and useful tool having means for removing a tri-lead cable from a housing without exerting uncontrolled pressure on the wires of the cable assembly.

A still further object of the present invention is to provide a novel and useful tool having manually operable spring-biased means for latching onto a tri-lead cable assembly in a housing and removing the assembly from the housing.

The foregoing and other objects, features and advantages of the invention will be apparent from the following more particular description of a preferred embodiment of the invention, as illustrated in the accompanying drawings.

DESCRIPTION OF PREFERRED EMBODIMENT

Figure 1:
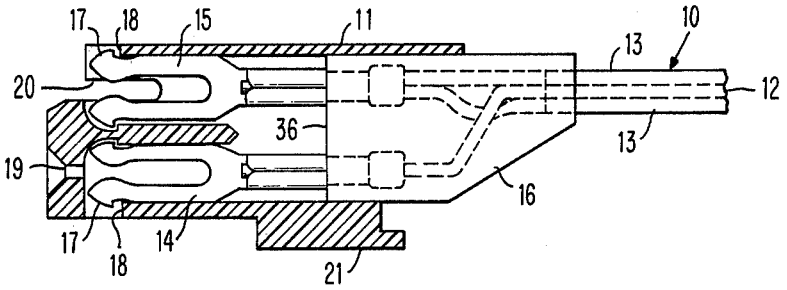
FIG. 1 is a cross-sectional view showing a tri-lead cable connected into a pluggable housing.

Referring to FIG. 1, there is shown a tri-lead cable 10 which has been inserted into a plastic housing 11. The cable comprises a center signal voltage wire 12 and two outer ground voltage wires 13. The signal wire 12 crosses over one of the ground wires 13 and is crimped to a metallic tuning fork shaped contact terminal 14 and the two ground wires 13 are crimped to a similar metallic contact terminal 15. Terminals 14 and 15 are arranged in a common plane. The crossover and crimped portion of the wires and terminals is bonded to an encapsulating tough dielectric film 16, such as, KAPTON, a trademark of E. I. du Pont de Nemours and Co. The ends of the contact terminals are provided with barbs 17 which hook onto latching surfaces 18 inside of the housing to removably retain the tri-lead cable in the housing. The opening in the end of the signal wire terminal 14 communicates with an opening 19 in the housing to enable plugging onto a signal pin on the printed circuit board and the opening in the end of ground wire terminal 15 communicates with a slot opening 20 in the housing to enable plugging onto a ground rail on the board. A T-bar projection 21 is provided on the housing for alignment of the removal tool.

Figure 3:
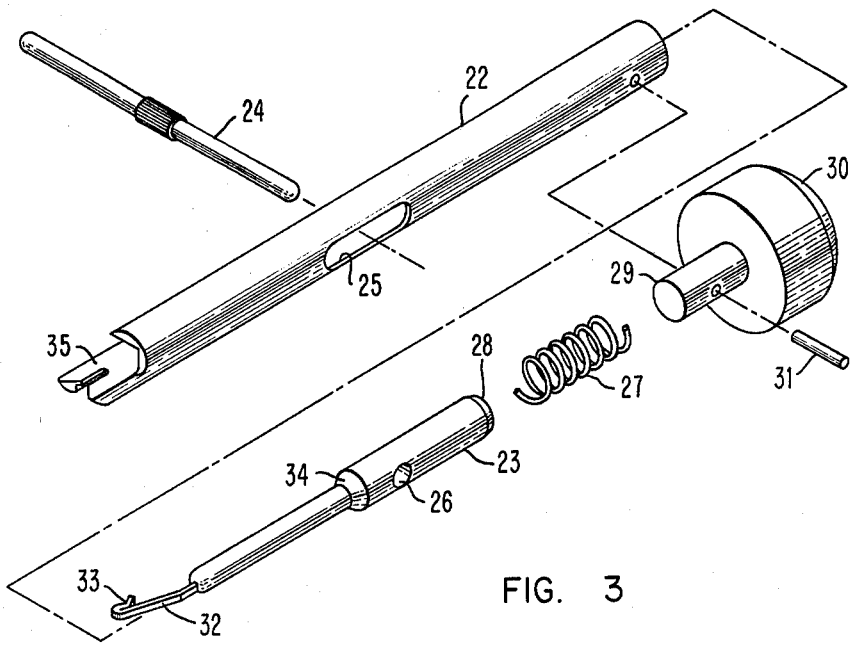
FIG. 3 is an exploded view showing the construction of the removal tool shown in FIG. 3.
Figure 4:
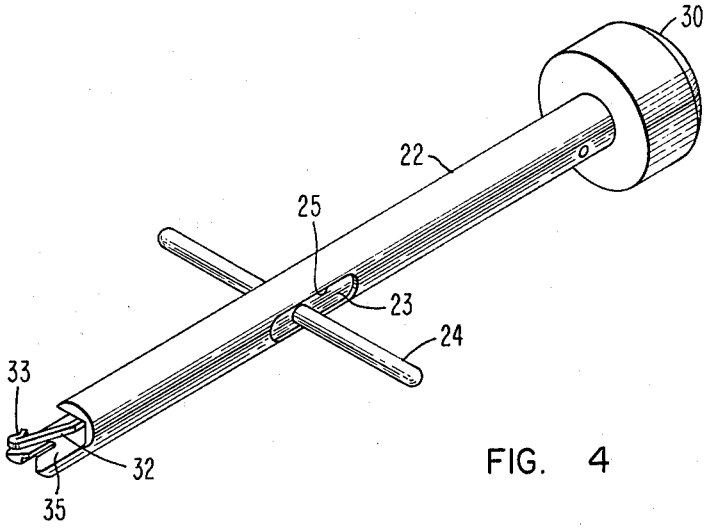
FIG. 4 is an assembly view of the tri-lead cable housing removal tool of the present invention.

Referring now to FIGS. 3 and 4, there is shown the tool of the present invention for removing the tri-lead cable from the assembly shown in FIG. 1. The tool comprises a hollow elongated barrel member 22. A spring-biased plunger 23 is slideably mounted in the barrel and has attached thereto a finger grasping bar 24 which extends through slots 25 in the sides of the barrel and is fixed in a hole 26 in the barrel. A compression spring 27 is mounted in the barrel and extends between a collar 28 on the plunger and the shank 29 of a knob 30 which is fastened to the end of the barrel by means of a pin 31. Attached to the plunger 23 is a thin spring blade 32 which extends out the open end of the barrel and on the exposed bent end of the blade is a hook portion 33. Spring 27 forces the collar 34 on the plunger against a stop surface in the barrel to normally maintain the plunger and blade in an outward or extended position, as shown in FIG. 4. In this position, the hooked end of the spring blade 32 is adjacent to a tuning fork or slotted blade extension 35 of the barrel.

Figure 2:
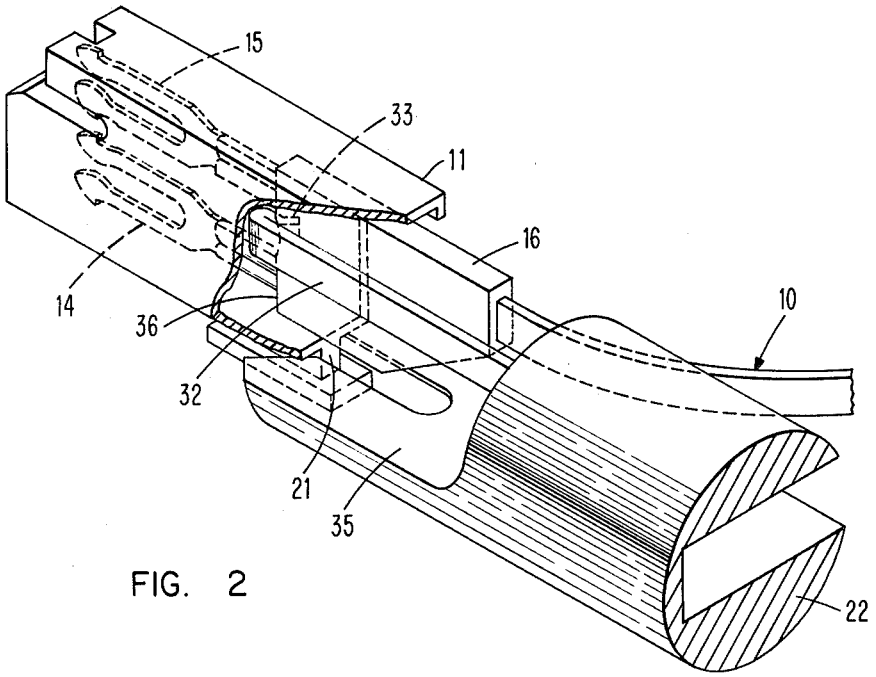
FIG. 2 is a partial isometric view showing the end of the removal tool of the present invention inserted into the housing shown in FIG. 1.

To remove the tri-lead cable from the housing, the tool is grasped with the knob in the palm of the hand and fingers on the finger bar and the spring blade 32 is inserted in between the housing and the encapsulating film 16 with the hook portion 33 facing inward and the tuning fork extension 35 of the barrel is guided into the T-bar projection 21 on the housing, as shown in FIG. 2. When the tuning fork extension seats into the T-bar, the tool is in alignment and the hook 33 on the spring blade will be positioned between the contact terminals and will hook onto the latching edge 36 of encapsulating film 16. Using the finger bar, plunger 23 is then pulled back against the spring which results in unlatching the barbs on the contact terminals and extraction of the tri-lead cable from the housing. After removal of the cable, the finger bar is released and the spring returns the plunger and spring blade to the normally extended position.

As was previously pointed out, the tool allows the cable to be freely removed from the housing without the use of any pressure which would damage the wires.

Although housing 11 has been shown as receiving one tri-lead cable, it may be constructed to receive two or more cables in the similar manner described. In the case where it houses more than one cable, the present tool is used, as above described, to remove one cable at a time and the spring blade should not be inserted between cable assemblies.

While the invention has been particularly shown and described with reference to a preferred embodiment thereof, it will be understood by those skilled in the art that various changes in form and detail may be made therein without departing from the spirit and scope of the invention.

What is claimed is:

1. A tool for removing from a housing a tri-lead cable having end contact terminals removably latched to said housing and having a portion bonded to an encapsulating film which extends partially into said housing, said tool comprising:

a hollow elongated body member;

a spring-biased plunger mounted within said body member;

a spring hook blade attached to said plunger and biased by said plunger to normally extend out an open end of said body member, said spring blade being inserted in between said housing and film to hook onto an edge of said film; and grasping means on said body member and connected to said spring-biased plunger for retracting said plunger and spring hook blade to unlatched and remove the hooked tri-lead cable from said housing.

2. A tool as set forth in claim 1 and including guide means which co-act with said housing to guide the insertion of said spring hook blade into the housing to hook onto an edge of said film.

3. A tool for removing from a housing a tri-lead cable having two end contact terminals having end barbs latched to said housing and having a portion bonded to an encapsulating film which extends partially into said housing, said tool comprising:

a hollow elongated body member;

a spring-biased plunger mounted within said body member;

a spring blade attached to said plunger and having a hooked end portion which normally extends out an open end of said body member and which is inserted in between said housing and film to hook onto an edge portion of said film which is located between said contact terminals; and grasping means on said body member and connected to said spring-biased plunger for manually retracting said plunger and spring blade to unlatched said barbs and remove the hooked tri-lead cable from said housing.

4. A tool as set forth in claim 3 wherein said grasping means comprises a hand knob fastened to one end of said body member and a finger bar attached to said plunger and extending through slots in said body member.

5. A tool as set forth in claim 3 further characterized by a tuning fork projection on the open end of said body member adapted to engage a T-bar projection on said housing for aligning the insertion of the tool.

* * * * *